US005235991A

United States Patent [19]

Minneman

[11] Patent Number: 5,235,991

[45] Date of Patent: Aug. 17, 1993

[54] MOUTH GUARD

[76] Inventor: Sue A. Minneman, 1055 Dunsford Pl., Cary, N.C. 27511

[21] Appl. No.: 929,962

[22] Filed: Aug. 14, 1992

[51] Int. Cl.[5] ..... A61C 5/14; A61C 5/00

[52] U.S. Cl. ..... 128/859; 128/861; 433/140

[58] Field of Search ..... 128/859-862, 128/112, 845, 848; 433/140; 2/46, 2, 2.1

[56] References Cited

U.S. PATENT DOCUMENTS

| | | | |
|---|---|---|---|
| 1,302,004 | 4/1919 | Brown | 128/861 |
| 2,521,084 | 9/1950 | Oberto | 128/141 |
| 2,614,560 | 10/1952 | Lee | 128/861 |
| 2,694,397 | 11/1954 | Herms | 128/861 |
| 2,833,278 | 5/1958 | Ross | 128/862 |
| 3,060,935 | 10/1962 | Riddell | 128/861 |
| 3,124,129 | 3/1964 | Grossberg | 128/862 |
| 3,385,291 | 5/1968 | Martin | 128/862 |
| 3,416,527 | 12/1968 | Hoef | 128/862 |
| 4,867,147 | 9/1989 | Davis | 128/861 |
| 4,944,947 | 7/1990 | Newman | 128/861 |

*Primary Examiner*—Michael A. Brown
*Attorney, Agent, or Firm*—Olive & Olive

[57] ABSTRACT

A mouth guard which has two main portions, a stiff, thin planar portion and a compressible portion. The thin, stiff planar portion is capable of deflecting mouth and cheek tissues. The planar portion extends from two arms, or the outer and upper aspect of a solid triangle, to a handle opposite the arms. The compressible portion extends above and below the plane of the planar portion on each arm.

10 Claims, 2 Drawing Sheets

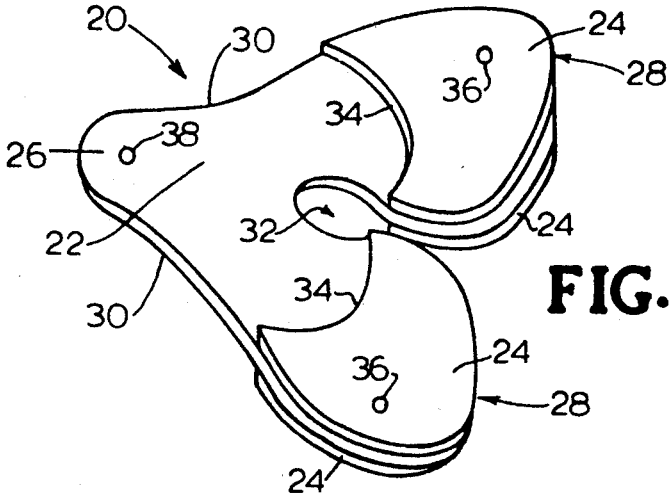
FIG. 1
FIG. 2
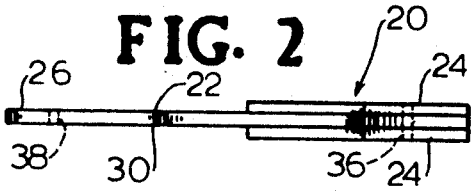
FIG. 3
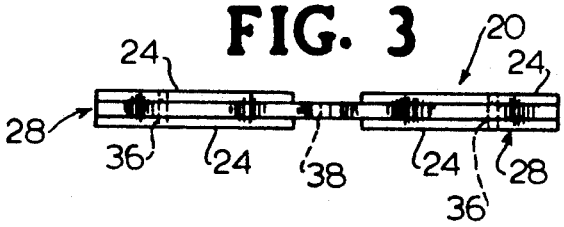
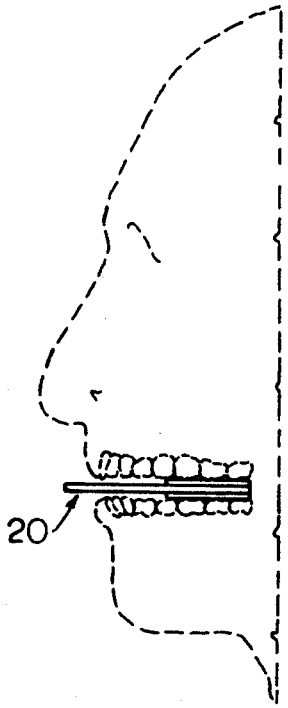
FIG. 4
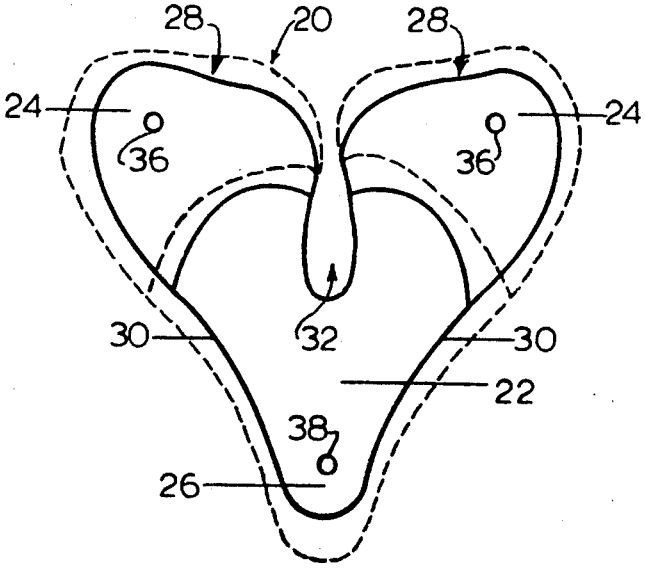
FIG. 5

MOUTH GUARD

BACKGROUND OF THE INVENTION

1. Field of the Invention

This invention relates to mouth guards and mouth props for use in electro-convulsive therapy (ECT).

2. Description of the Related Art

During shock therapy (electro-convulsive therapy), a portion of the stimulus current passes through the muscles of mastication, resulting in the forcible contracture of the jaws for the duration of the stimulus. This contracture may result in fracture or other damage to the teeth. The type and extent of damage is affected by the health of the teeth and the pressure on the teeth. Thus, when patients lack some of their teeth, there are fewer teeth to distribute the loading stress and an element of support and stabilization for the adjacent and opposing teeth is absent. Inadvertent damage to the teeth may have serious cosmetic, functional and/or medicolegal significance. In addition to damage to the teeth, uncontrolled jawlock may cause damage to soft tissue such as the tongue, cheek buccal mucosa, lips and muscles from bites or impingements; damage to the temporomandibular joints and muscle of mastication from strain or dislocation or over extension or over flexion; and entry of debris, blood and other material into the respiratory system.

Many different mouth guards have been designed to prevent tooth and mouth injury to patients who are receiving ECT. Some of these guards also have features particularly useful in keeping the throat of an ECT patient from becoming obstructed. Many of the prior mouth guards have complicated structures to accomplish these purposes.

The early patent of Freedland (U.S. Pat. No. 2.459,273) is for a shock therapy mouth guard with a rubbery pad mounted between the ends of a rigid handle. A longitudinal passage is formed on top of the handle on the pad. The lower teeth of a patient are placed between two arcuate projections on the lower surface of the pad. The disclosure of this patent and all other patents and publications cited herein is hereby incorporated herein by reference.

Some of the tooth guards have elaborate molded flanges for protection of the front teeth and an attached breathing tube (See U.S. Pat. Nos. 2,669,988 of Carpenter; 2,882,893 of Godfroy; and 4,112,939 of Blachly). Others are simpler in form, being essentially V-shaped (U.S. Pat. No. 4,867,147 of Davis) or Y-shaped (U.S. Pat. Nos. 2,694,397 of Herms and 4,944,947 of Newman).

Even simpler is the disposable BITE TM jawlock of U.S. Pat. No. 3,971,370 which is simply a tongue depressing stick with a polyethylene foam pad at one end. For use in ECT, one of the BITE TM jawlocks is placed on each side of the oral cavity, but because the BITE TM jawlock does not fill the oral cavity, it is often difficult to keep the two jawlocks in the correct place to prevent patient injury.

Other mouth guards are particularly designed for use by athletes, and are primarily made to surround and protect all of the player's teeth, for example, U.S. Pat. Nos. 3,496,939 of Gores and 5,082,007 of Adell. Other mouth guards are designed for use by persons undergoing operations requiring intubation, for example, U.S. Pat. No. 3,513,838 of Foderick, or to firmly depress and hold a patient's tongue, for example, U.S. Pat. No. 4,041,937 of Diaz.

It is important that mouth guards used for ECT be both inexpensive to construct so that they can be disposable; be able to fit all patients, i.e, with different sizes of oral cavity or different numbers and arrangements of remaining teeth using a minimum number of mouth guard models; provide sufficient cushioning to minimize tooth damage; and allow the anesthetized patient to be ventilated while the mouth guard is positioned in the oral cavity. The prior mouth guards generally are deficient in one or more of these aspects.

It is therefore an object of this invention to provide a mouth guard for ECT which can be manufactured inexpensively. The mouth guard of the invention may also be used for numerous other procedures, including, for example, procedures requiring positioning of the maxilla and mandible for a period of time, film studies, magnetic resonance studies, and other procedures.

It is a further object of this invention to provide a mouth guard which can be used by patients having any one of a number of mouth sizes and which accommodates a varied number and arrangement of remaining teeth.

It is a further object of this invention to provide a mouth guard which is effective in minimizing tooth damage and other damage to the patient.

It is a further object of this invention to provide a mouth guard which allows a patient to be ventilated while the mouth guard is in the patient's oral cavity.

Other objects and advantages will be more fully apparent from the following disclosure and appended claims.

SUMMARY OF THE INVENTION

The mouth guard of the invention has two main portions: a stiff, thin planar portion, and a compressible portion. The planar portion is stiff enough so that it is capable of deflecting mouth and cheek tissues. It is thin enough so that when positioned in the oral cavity it does not obstruct the anterior aspect of the mouth when the jaws are clamped on the compressible portion of the device. The planar portion extends from two arms which together form a "V" to a single handle opposite the arms. The components of the compressible portion when affixed in their respective four positions extend above and below the plane of the planar portion on each arm.

The mouth guard of the invention displaces soft tissues away from the dentition and allows for muscle contour during clenching; provides bilateral balance to the mandible; maintains the vertical dimension between the maxilla and mandible; and with respect to the patients dentition, keeps occlusal forces on anatomical areas which are physiologically designed for loading, i.e., the molars and previously molar bearing areas and does not occlude the weaker teeth, i.e., the maxillary and mandibular incisors.

Other aspects and features of the invention will be more fully apparent from the following disclosure and appended claims.

BRIEF DESCRIPTION OF THE DRAWINGS

FIG. 1 is a perspective view of a mouth guard of the invention.

FIG. 2 is an elevational side view of the mouth guard of the invention.

FIG. 3 is an elevational back end view of the mouth guard of the invention.

FIG. 4 is an elevational side view of the guard showing its location in an oral cavity.

FIG. 5 is a plan view of the mouth guard of the invention which may be used in a small oral cavity, with a size for a larger oral cavity shown in dotted lines.

DETAILED DESCRIPTION OF THE INVENTION AND PREFERRED EMBODIMENTS THEREOF

Figure 6:
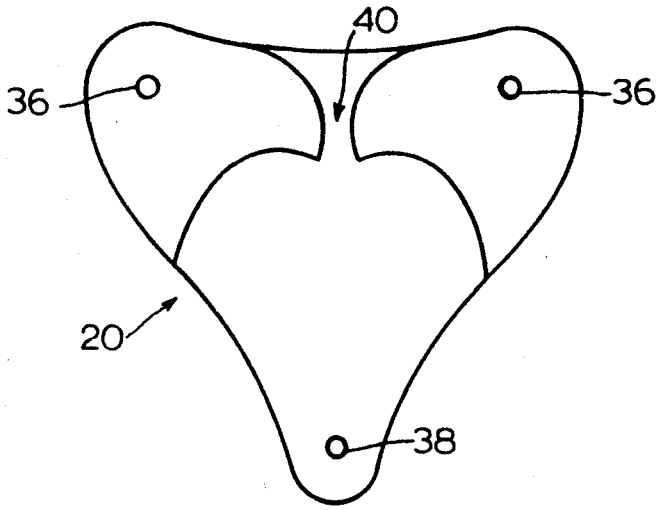
FIG. 6 is a plan view of a second embodiment of the mouth guard of the invention.

The mouth guard 20 of the present invention provides a means of protecting the teeth, for example, of an ECT patient. In particular, the mouth guard's multi-thickness structure and its two materials of construction provide protection of the teeth and soft tissue during the forcible contracture of the jaws. The mouth guard 20 of the invention has two main portions, a planar portion 22 and a compressible portion 24. The planar portion 22 and the compressible portions 24 are different in thickness and overall size, and have different physical characteristics from each other. In addition, the compressible portions may also be different in thickness as discussed below.

Referring now to the figures, the planar portion 22 is generally triangular in shape and is planar with two parallel flat sides. In a first embodiment, the planar portion 22 extends from a handle portion 26, which can be considered the base of a "Y", to the ends of the two arms 26 of the "Y", with the arms 26 forming a "V" with each other (FIG. 1).

In a second embodiment shown in FIG. 6, the planar portion 22 extends upward from the handle portion 26 and broadens so that the planar portion is generally in the shape of a solid triangle. Because the compressible portions 24 have generally the same shape in each embodiment and are located or are affixable generally along the side of the triangular planar portion 22 opposite the handle portion 26, this location is termed the arm in each embodiment, even though the planar portion in the second embodiment is not divided into the distinct arms found in the first embodiment.

As used herein the words "up" and "down" (and derivative words), refer respectively to positions on the mouth guard 20 or part thereof when placed in the letter "Y" in written use. The term "side" refers to a planar surface of the planar portion 22 or attached compressible portions 24. The terms "outer" and "inner" refer respectively to the relative location on the plane of a side, with locations around the edge being outer locations, and locations toward the center of the planar side being inner locations.

The shape of the preferred embodiment of the invention varies from a simple "Y" form. Preferably there is a slight indentation 30 in the outer edge of the planar portion 22 between the handle portion 26 and the arms 28 which allows the lips to return to a relaxed posture so that there is no stretching of the lips once the device is in position in the oral cavity. The planar portion 22 also deflects the inner surfaces of the cheeks away from the pressure-bearing teeth or edentulous ridges to prevent impingement.

The arms 28 extend upward from a relatively narrow neck portion to an expanded portion and taper upward and outward to a somewhat narrower area as shown in FIGS. 1 and 5. The outer edge of the mouth guard 20, which is coextensive with the outer side edge of the planar portion 22 is therefore generally smooth and rounded for placement in a patient's oral cavity as shown in FIGS. 1 and 5. The cut-out area 32 formed by the inner edges of the arms has a generally teardrop shape in the embodiment shown in FIG. 1 allowing air to pass through the mouth guard 20 when the mouth guard 20 is placed in an oral cavity and held by the teeth or edentulous ridges, but in the second embodiment is solid which still allows air to flow through the trench 40 formed between the compressible portions 24 as shown in FIG. 6.

The planar portion 22 must be stiff enough so that it is capable of deflecting oral cavity tissue and is thin enough so that it does not obstruct the oral cavity unnecessarily when the mouth guard 20 is clamped in the mouth. Thus, the preferred planar portion 22 is one layer as shown in the Figures and comprises one sheet of stiff cardboard about 1.5–4.0 mm in thickness. Thus, as used herein, "thin" means having a thickness of about 1.5 to about 4.0 mm or somewhat thinner or thicker so long as it has the strength of the preferred thickness. Cardboard having the characteristics of matte board is acceptable in stiffness, as is wood such as is used in tongue depressors having a thickness of about 2 mm, pressed paper, fiber board or particle board with a thickness, for example, of 1–2 mm, plastic or firm foam.

The compressible portions 24 of the mouth guard 20 are located or affixed by adhesive at the expanded upper area of each arm 28 as shown in FIG. 1 and do not extend into the remaining area of the mouth guard 20.

It is particularly important that the compressible portions 24 not extend beyond, or at least much beyond the area shown in the figures so that they do not come in contact with canines and incisors and premolar teeth when placed in the oral cavity (see below). As shown in FIGS. 2–3, each compressible portion 24 extends above and below the plane of the planar portion 22 on each arm. Preferably the compressible portions 24 extends about 2½ mm above or below the planar portion when teeth rest upon it and about 5 mm above and below the planar portion when no molar teeth are present to rest upon the compressible portion.

Preferably in the invention as shown in FIG. 1 (discussed in more detail below), the outer edge of each compressible portion 24 is coextensive with the planar portion 22 to which it is attached or can be affixed, and the inner edge of the compressible portion 24 has a concave side 34 toward the handle portion 26 which extends from a point on the arm 28 where the two arms are close together to the outer side of the arm 28. The width of each compressible portion 24 measured at any place is preferably about 1–3 cm.

In the preferred embodiment of the invention where the planar portion 22 is entirely coterminous with the mouth guard 20 itself, the compressible portion 24 on each arm 28 is divided into two compressible pieces, one on each side of the planar portion 22 extending into arm 24 as shown in FIG. 1. Each compressible piece is attached or can be selected and affixed t the planar piece 22 along their contiguous surfaces by glue or by other means known in the art which allow a firm, non-toxic binding of the two materials.

In an alternate, less preferred embodiment, the planar portion does not extend all of the way to the end of the arms of the mouth guard, and has only truncated arms, ending at or just inside a single compressible portion, which is attached at the end of the truncated arms, perhaps by insertion of the end of the truncated arms partway into the compressible portion. The dimensions of the arms 28 are the same in either embodiment with the compressible portion extending above and below the plane of the planar portion for preferably about 5 mm. In this embodiment it is particularly important that the planar portion does not become separated from the compressible portion, which would cause foreign body risk.

In the arm of each embodiment, preferably each compressible portion 24 and the planar portion 22 to which it is attached have a hole 36 extending therethrough as shown in FIG. 1, and a piece of dental floss or the like (not shown) is threaded through each hole 36 and knotted to secure the two compressible pieces 24 on each planar portion 22. This feature is provided for additional safety, in the event the compressible portion(s) become unglued from the planar portion.

Each compressible portion 24, including both pieces thereof, is made of a material having the compressibility and durability of polyethylene foam, polystyrene plastic, such as STYROFOAM TM, rubber or other sturdy but compressible material, and most preferably is made of polyethylene foam.

Because the mouth guard 20 planar portion 22 has an identical appearance on each of its sides, with the two arms 28 being mirror images of each other, the mouth guard 20 may be placed in the oral cavity with either side uppermost. In the embodiment where the compressible portions are selected for the particular tooth configuration, and affixed to the planar portion, the mouth guard 20 may be configured to have a different structure on each side of the mouth guard 20.

Thus, with the mouth guard 20 held generally horizontally with either side of the mouth guard 20 uppermost, the invention is used a follows: the medical practitioner affixing appropriate compressible portions 24 holds the handle portion 26 and places the mouth guard 20 in position in the patient's oral cavity (FIG. 4) so that the arms 28 are located inside the oral cavity along the inner sides of the cheek, and each compressible portion 24 is located between the upper and lower posterior molars or the edentulous alveolar ridge in the molar area on one side of the oral cavity. When the patient's jaws clamp together, they press into each compressible portion 24 at the point where they contact it. The firmness of the preferred compressible material keeps the teeth, or the previous tooth bearing area from contacting the planar piece or other teeth even when the jaw is locked.

In a preferred method of packaging the device of the invention, a planar portion of a particular size having a covered adhesive area on both sides of the arm area in the first embodiment, or on both sides of the wide side of the triangle opposite the handle portion in the second embodiment, is packaged with a plurality of compressible portions 24. Most preferably, the package contains at least four thinner compressible portions, for example, having a thickness of about 2½ mm, and another four thicker compressible portions, for example, with a thickness of about 5 mm. These two thicknesses are used in the examples herein, but it is clear that small adjustments in thickness in this general range are within the preferred scope of the invention. Having two different thicknesses of compressible portion which are affixable to a planar portion 22 allows the medical practitioner placing the device in an oral cavity to tailor the thickness of the compressible portion of the device for the particular oral cavity.

Figure 7:
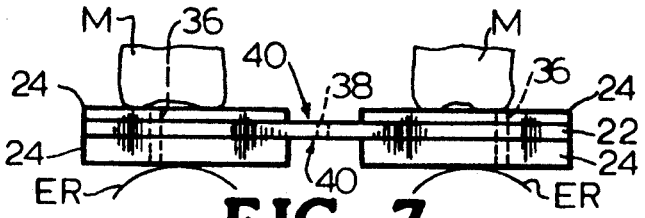
FIG. 7 is an elevational back schematic view of the embodiment shown in FIG. 6 in use in an oral cavity having upper molars and lower edentulous ridges.

Thus, when selecting compressible portions for particular patients, where the patient has molars in all four quadrants, the 2½ mm compressible portions are preferably used on both sides of each arm area of the device. Where the patient has edentulous ridges in all four quadrants, 5 mm compressible portions are preferably used on both sides of each arm area of the device. When the patient has upper molars on both sides but lower edentulous ridges on both sides, a device as shown in cross-section in FIG. 7 can be used, having 2½ mm compressible portions on the side of both arms facing the molars, labeled M in the Figure, and 5 mm compressible portions on the side of both arms which faces the edentulous ridges, labeled ER in the Figure. The device assembled as shown in this Figure can be flipped over for a person having the opposite arrangement of teeth and edentulous ridges. It is clear than for any combination of jaws with teeth or edentulous ridges, the two thicknesses of compressible portions may be arranged appropriately for the particular patient so that the device has a total of four compressible portions of which from 0–4 are the thinner 2½ mm compressible portions, and from 0–4 are the thicker 5 mm compressible portions.

Varied thicknesses and the width of the compressible pieces makes the mouth guard 20 usable for teeth in a variety of sizes and arrangements and cavities with varying widths between posterior aspects of the alveolar ridges, either tooth-bearing or edentulous. The more fragile premolar, canine and incisor teeth are held apart because the molars or edentulous molar area are held apart by the compressible pieces. If a patient using the mouth guard 20 has missing teeth in front of the molars, there is no effect on the efficiency of the mouth guard 20, and even if a few molars are missing, the pressure is generally distributed over the remaining molars and the mouth guard 20 functions satisfactorily. If there are few molars, no molars, or very uneven spacing of molars, the load is evenly distributed in the four posterior quadrants by utilizing different thicknesses of compressible portions to accommodate the particular tooth or no tooth condition.

In alternate embodiment of the invention for use with patients not requiring accommodation with particular arrangements of compressible portions, the device is made in one piece, for example entirely of a compressible foam. The planar portion of this embodiment is pressed into a very hard firm layer by compression means known in the art, taking care not to compress the arms of the device. The resultant device is shaped as shown in FIGS. 1 or 6, but is all one piece. It is important that the foam used in this embodiment, because no other planar piece is employed to provide integrity and support, be particularly sturdy, and resistant to breaking.

When the device in any of the embodiments discussed herein is used, the handle portion 26 preferably protrudes from between the front teeth or is graspable if necessary, but the handle portion 26 is short enough so that a ventilation mask can be placed over it. Preferably the handle portion 26 has a hole 38 as shown in FIGS. 1 and 5 through which a piece of floss may be placed as a safety feature to assist in retrieving the device from the oral cavity.

Preferred relative dimensions of the invention for a standard small oral cavity and a larger oral cavity are shown in FIG. 5. In the preferred dimensions, the width of the arm 28 at its widest point is about 3 to 3.5 cm and the width of the arm 28 at its narrowest point is about 1.5 to 1.7 cm. The length of the mouth guard 20 as a whole, from tip of handle portion 26 to end of an arm 28, is preferably about 6.7 to 7.7 cm, and the width across the mouth guard 20 as a whole at the widest point is preferably about 6.5–7.5 cm.

Two or more models of mouth guard 30 may be provided because although a larger model might be able to be used in most smaller oral cavities, it might be more difficult to insert into a small oral cavity than a smaller size mouth guard 30. The larger model, most useful by persons with a larger oral cavity, has a greater surface so that the molars of the person with a larger oral cavity, which might be close to the edge of the compressible area of a smaller model, are firmly placed on the compressible area of the larger model.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A mouth guard, comprising:

(a) a thin, stiff planar portion capable of deflecting mouth and cheek tissues, said planar portion forming a single, generally triangular plane with an arm along each side of said triangular plane and a single handle at an opposite end of said planar portion from said arms, each of said arms having a narrower neck portion adjacent said handle and an expanded portion distal from said handle; and (b) a compressible portion located on the expanded portion of each arm, each compressible portion extending above and below said handle and said plane so that when said mouth guard is placed in a mouth the teeth contact the compressible portion and are held away from contact with the planar piece, wherein the length of the handle is short enough so that the distance between the end of the handle and the end of either arm is about the same as the width of the mouth guard at the expanded portion of the arms.

2. A mouth guard according to claim 1, wherein said planar portion comprises a sheet of material selected from the group consisting of cardboard, wood, fiberboard, pressed paper, matte board and particle board.

3. A mouth guard according to claim 1, wherein said planar portion has a lower planar surface and an upper planar surface and each of said compressible portions comprises two compressible pieces, one of which pieces is attached to the upper planar surface of the arm and the other of which pieces is attached to the lower planar surface of the arm.

4. A mouth guard according to claim 3, wherein said pieces are made of polyethylene foam.

5. A mouth guard according to claim 1, wherein said handle has a hole through said planar portion, and each of said arms has a hole through said planar portion and said affixed compressible portions.

6. A mouth guard according to claim 1, wherein said compressible portions are adhesively attached to said planar portion and are of a selected thickness for the teeth of a particular patient.

7. A mouth guard, comprising:

(a) a thin, stiff planar portion capable of deflecting mouth and cheek tissues, said planar portion forming a single, generally triangular plane with an arm along each side of said triangular plane and a single handle at an opposite end of said planar portion from said arms, each of said arms having a narrower neck portion adjacent said handle and an expanded portion distal from said handle; and (b) a plurality of compressible portions, each of said compressible portions adhesively attached to either side of the expanded portion of said planar portion on each arm each said compressible portion is attached to said planar portion extending above and below said plane, wherein when the mouth guard is placed in a mouth, the teeth contact the compressible portion and are held away from contact with the planar piece.

8. A mouth guard according to claim 7, wherein said plurality of compressible portions comprises compressible portions having a first thickness and compressible portions having a second thickness equal to twice said first thickness.

9. A mouth guard according to claim 8, wherein said first thickness is about 2½ mm.

10. A mouth guard according to claim 7, wherein said handle has a hole through said planar portion, and when said compressible portions are affixed to said arms, each of said arms has a hole through said planar portion and said affixed compressible portions.

* * * * *